US011844984B2

(12) United States Patent
Khemchand

(10) Patent No.: US 11,844,984 B2
(45) Date of Patent: Dec. 19, 2023

(54) BALL RETRIEVING ASSEMBLY

(71) Applicant: Pushpa Khemchand, Cumming, GA (US)

(72) Inventor: Pushpa Khemchand, Cumming, GA (US)

( * ) Notice: Subject to any disclaimer, the term of this patent is extended or adjusted under 35 U.S.C. 154(b) by 274 days.

(21) Appl. No.: 17/363,103

(22) Filed: Jun. 30, 2021

(65) Prior Publication Data

US 2023/0001270 A1 Jan. 5, 2023

(51) Int. Cl.
*A63B 47/02* (2006.01)

(52) U.S. Cl.
CPC ..... *A63B 47/02* (2013.01)

(58) Field of Classification Search
CPC ..... A63B 47/02; A63B 47/021
USPC ..... 294/19.2
See application file for complete search history.

(56) References Cited

U.S. PATENT DOCUMENTS 3,117,814 A * 1/1964 Webb ..... A63B 47/02 294/99.1
4,252,490 A 2/1981 Keller
4,461,504 A * 7/1984 Perez ..... A63B 47/02 294/19.2
5,464,262 A * 11/1995 Madrazo ..... A63B 47/02 294/19.2
6,354,643 B1 * 3/2002 Podejko ..... A63B 47/02 294/19.2
6,412,839 B1 * 7/2002 Tran ..... A63B 47/02 294/19.2
7,753,420 B2 * 7/2010 Beavin ..... A47C 13/00 294/19.2
7,866,719 B1 * 1/2011 Lucca ..... A63B 47/00 473/173
9,339,698 B2 5/2016 Zhang
2007/0017948 A1 1/2007 Smithson
2014/0356114 A1 * 12/2014 Budacsek ..... A63B 47/02 414/495

* cited by examiner

*Primary Examiner* — Dean J Kramer

(57) ABSTRACT

A ball retrieving assembly for collecting balls on a surface includes a basket that has a pair of elastomeric openings integrated into the basket to pass a ball into the basket for transporting the ball. A plurality of rollers is each movably coupled to the basket each of the rollers is urgeable into a compressed condition to facilitate the basket to be lowered to the support surface. In this way balls lying on the support surface can pass through respective ones of the elastomeric openings for positioning the balls in the basket. A pair of handles is each removably attachable to the basket for urging the rollers into the compressed condition when handles are pressed downwardly.

6 Claims, 6 Drawing Sheets

BALL RETRIEVING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to retrieving devices and more particularly pertains to a new retrieving device for collecting balls on a surface. The device includes a cart with a plurality of compressible rollers for lowering the cart onto a support surface. The cart has a plurality of cuts that facilitate balls to pass into the cart when the cart is lowered for collecting the balls in a hands-free manner.

(2) Description of Related Art Including Information Disclosed Under 37 CFR 1.97 and 1.98

The prior art relates to retrieving devices including a cart that has a chute for collecting balls on a surface. The prior art discloses a variety of ball carrying bags that have a ball retrieval tool included for picking up balls from the ground. In no instance does the prior art disclose a cart with cuts integrated therein which can be lowered to the ground for collecting balls through the cuts.

BRIEF SUMMARY OF THE INVENTION

An embodiment of the disclosure meets the needs presented above by generally comprising a basket that has a pair of elastomeric openings integrated into the basket to pass a ball into the basket for transporting the ball. A plurality of rollers is each movably coupled to the basket each of the rollers is urgeable into a compressed condition to facilitate the basket to be lowered to the support surface. In this way balls lying on the support surface can pass through respective ones of the elastomeric openings for positioning the balls in the basket. A pair of handles is each removably attachable to the basket for urging the rollers into the compressed condition when handles are pressed downwardly.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
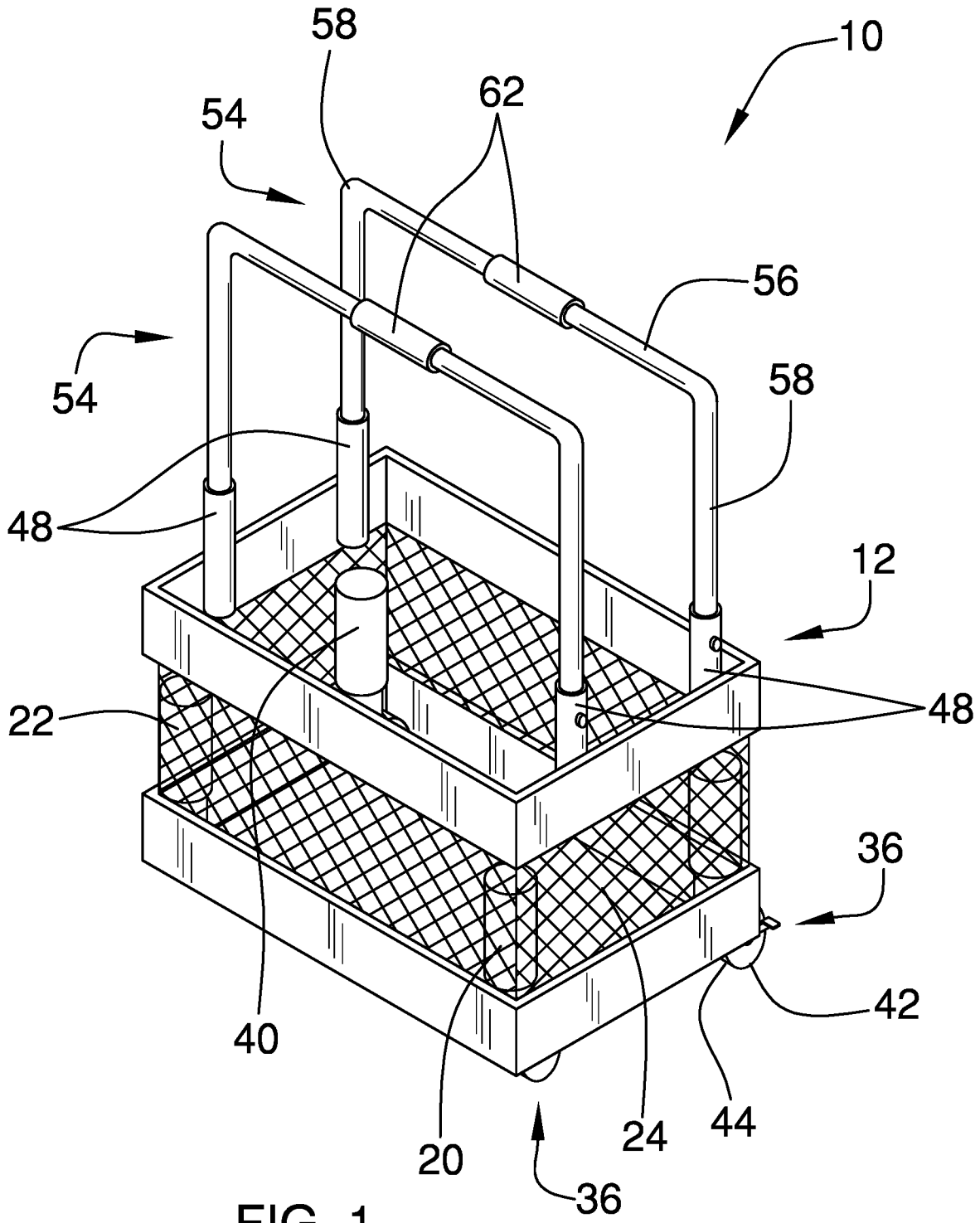
FIG. 1 is a top perspective view of a ball retrieving assembly according to an embodiment of the disclosure.
Figure 2:
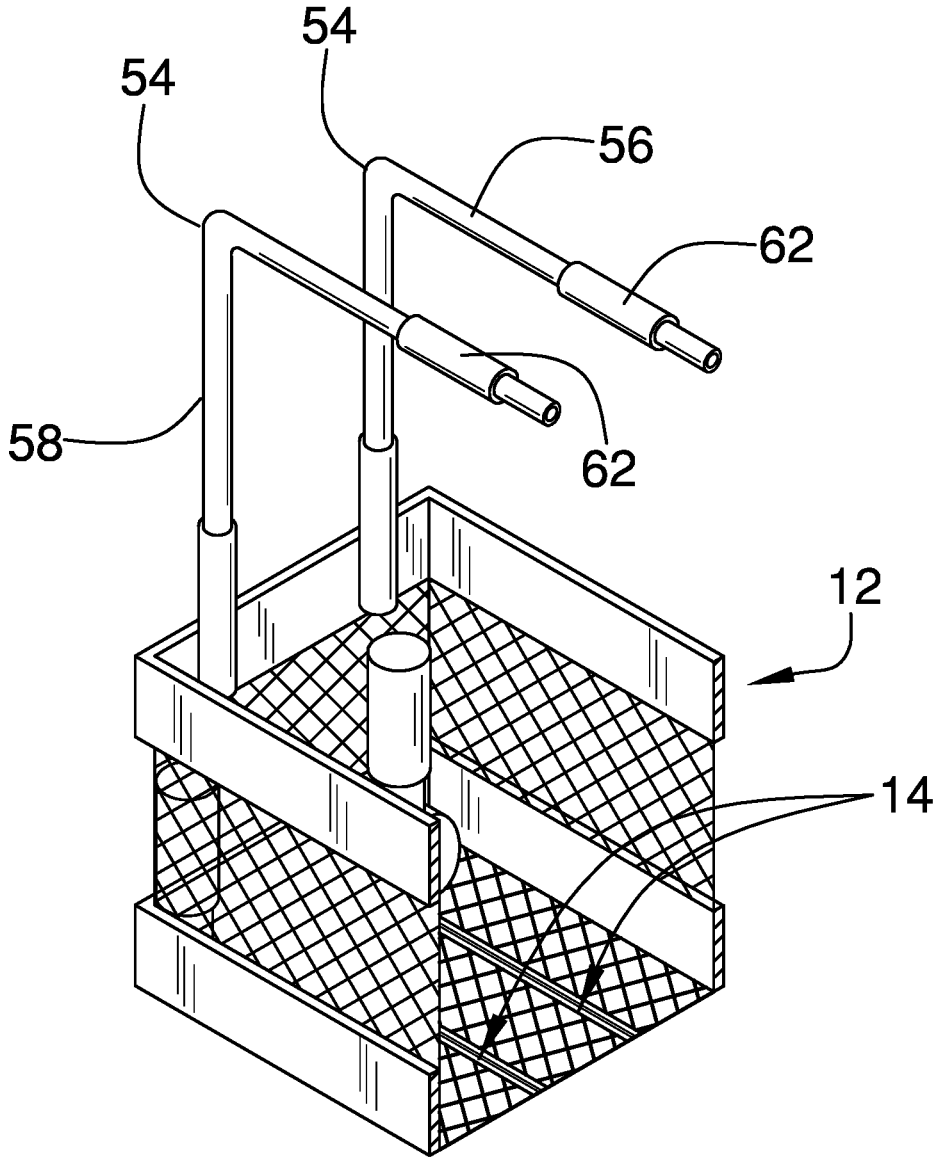
FIG. 2 is a perspective cut-away view of an embodiment of the disclosure.
Figure 3:
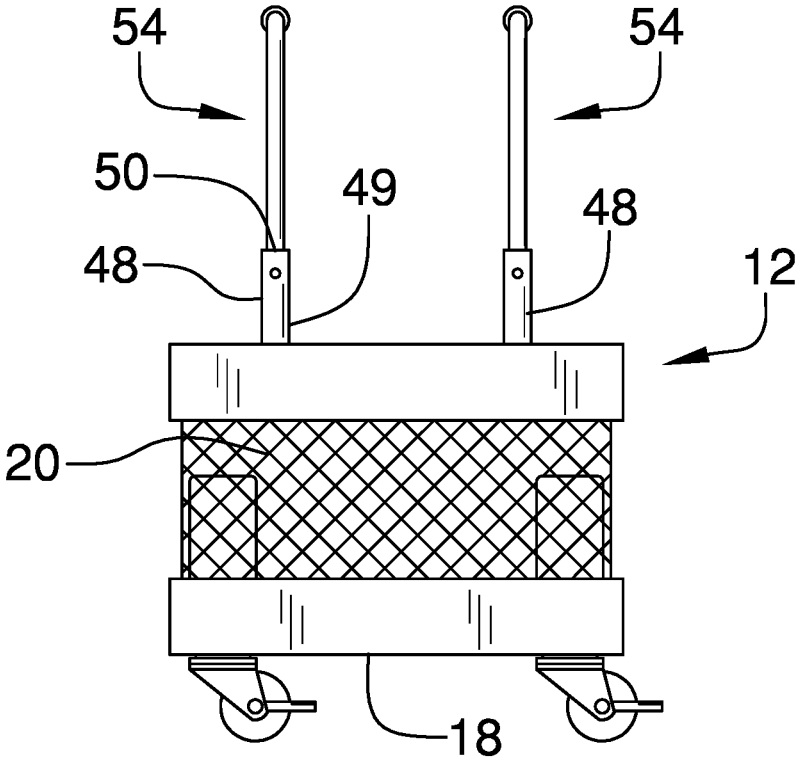
FIG. 3 is a right side view of an embodiment of the disclosure.
Figure 4:
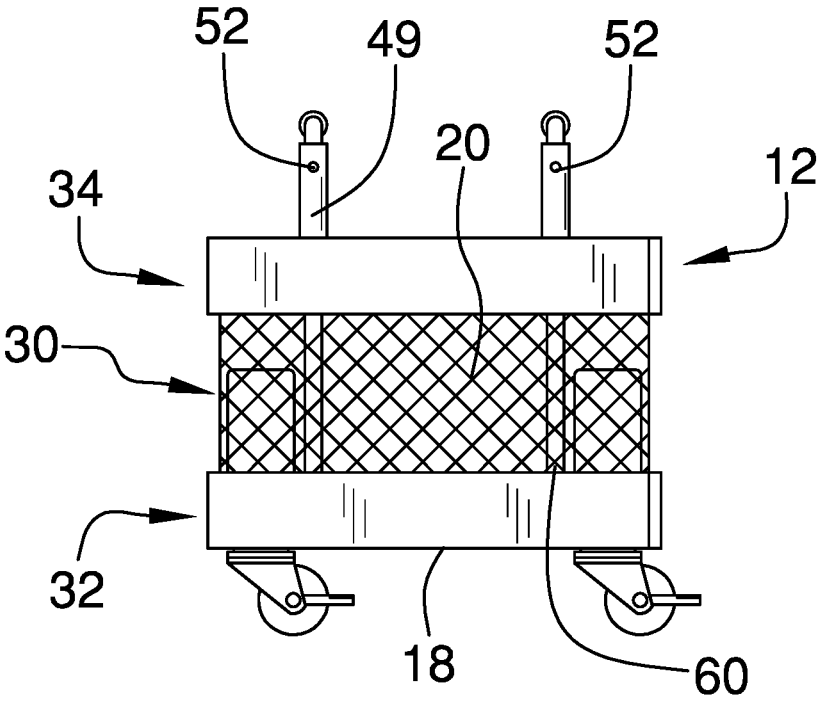
FIG. 4 is a left side view of an embodiment of the disclosure.
Figure 5:
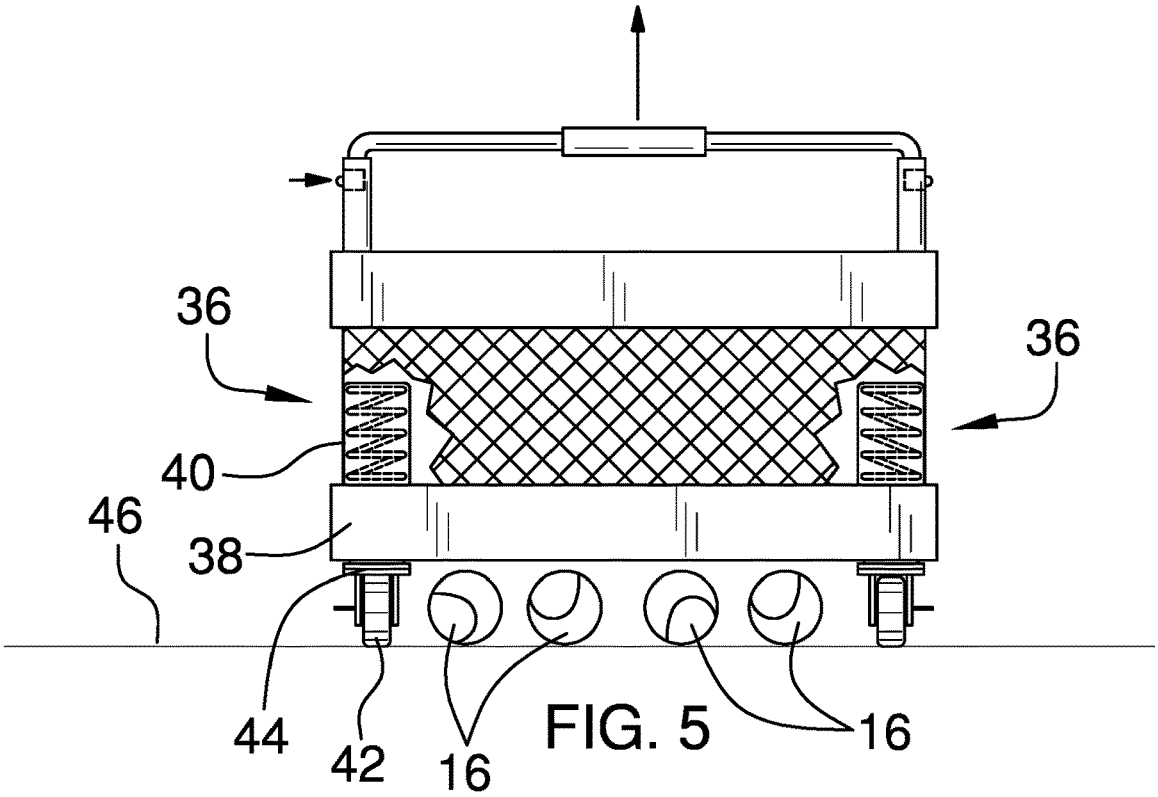
FIG. 5 is a front view of an embodiment of the disclosure.
Figure 6:
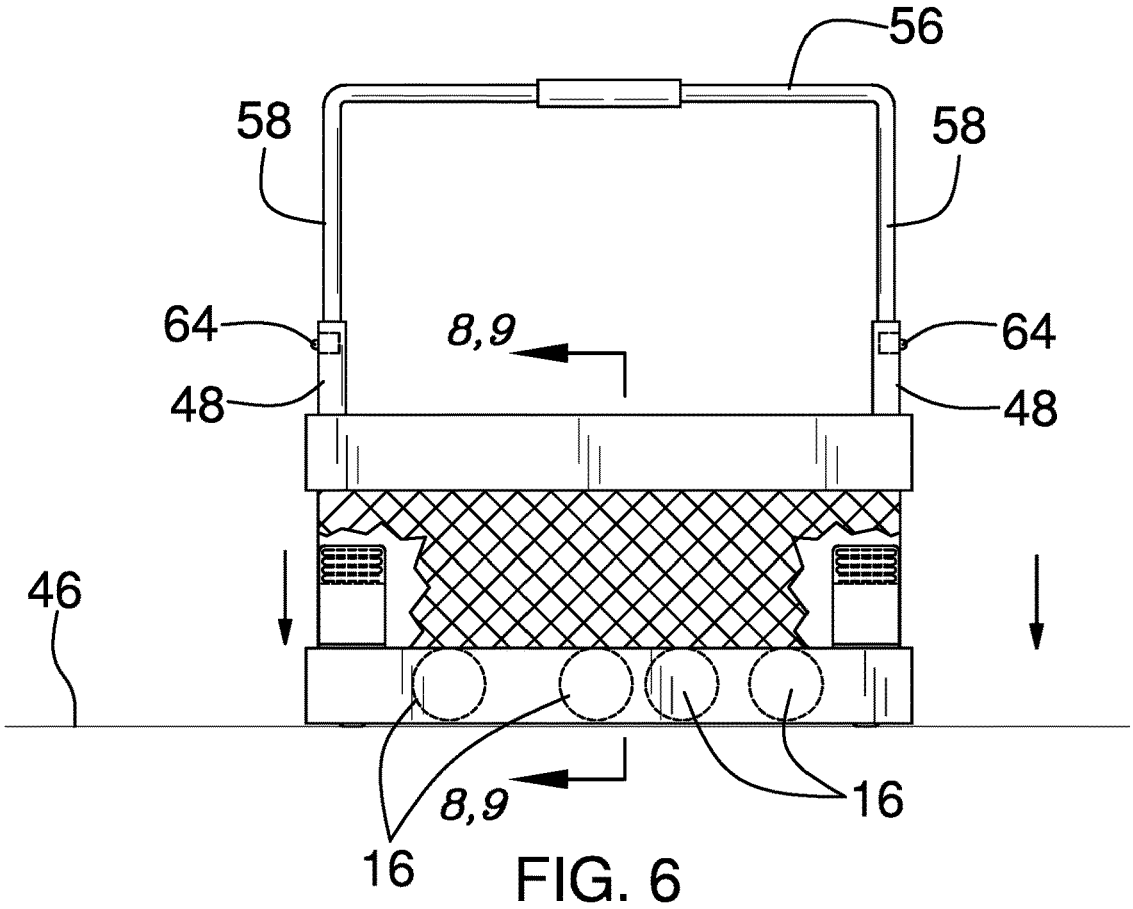
FIG. 6 is a perspective in-use view of an embodiment of the disclosure showing a cart being lowered onto a plurality of balls.
Figure 7:
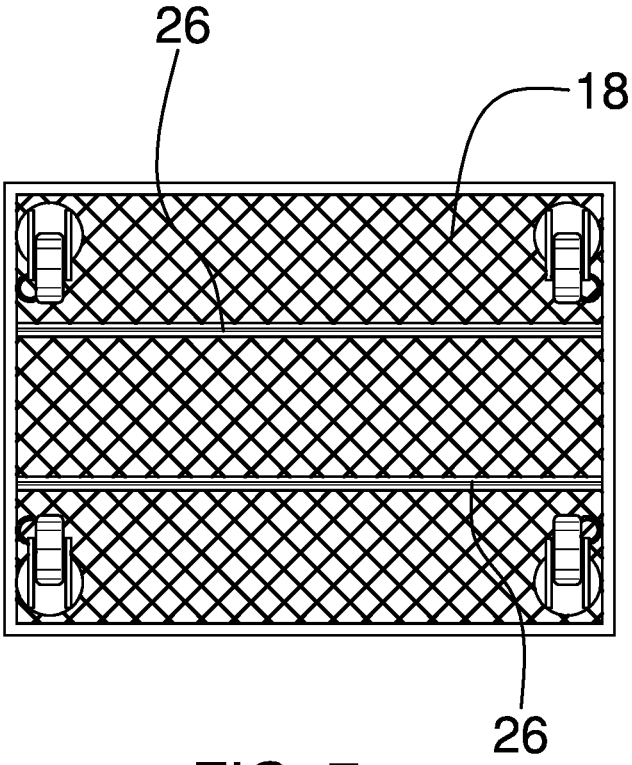
FIG. 7 is a bottom view of an embodiment of the disclosure.
Figure 8:
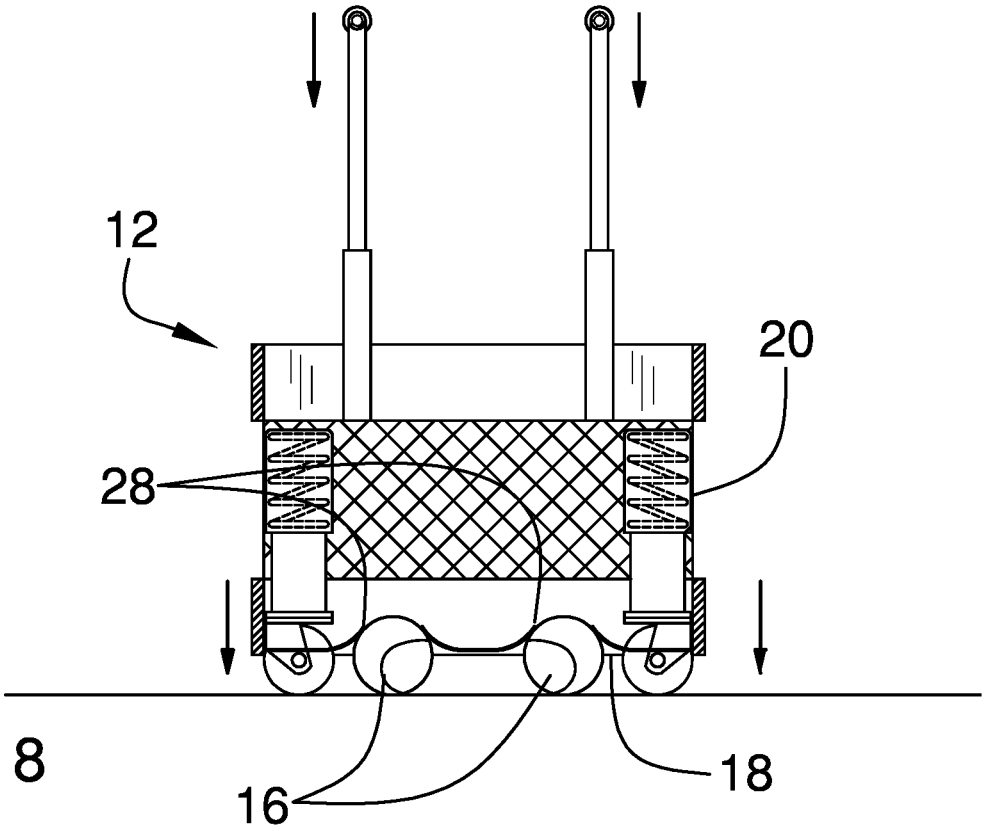
FIG. 8 is a cross sectional view taken along line 8-8 of FIG. 6 of an embodiment of the disclosure.
Figure 9:
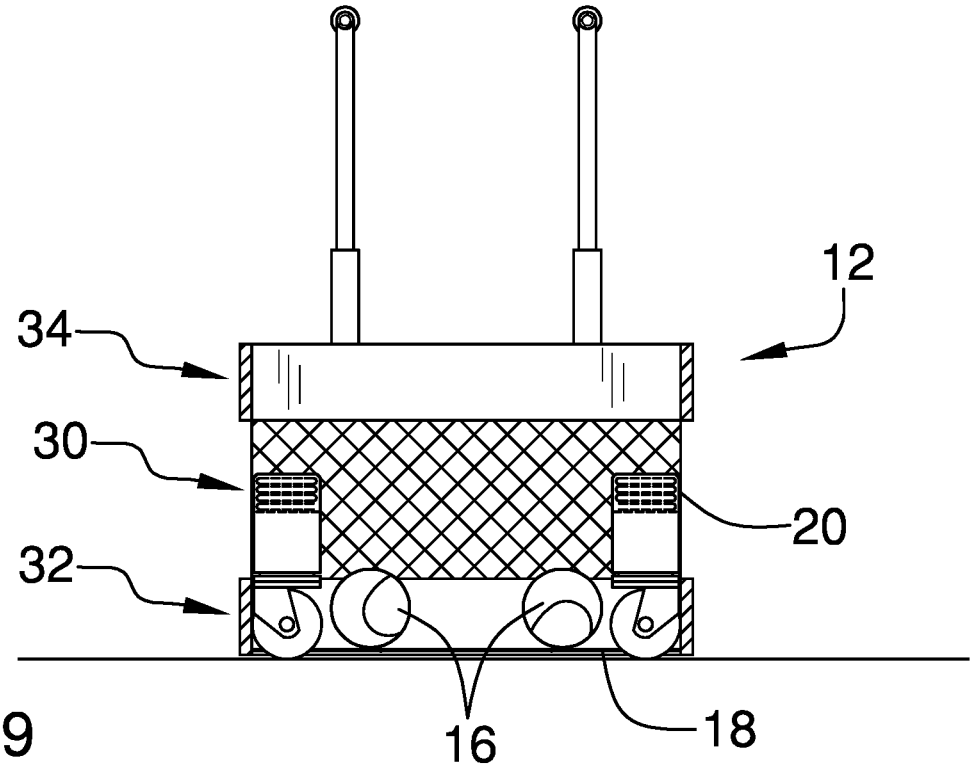
FIG. 9 is a cross sectional view taken along line 9-9 of FIG. 6 of an embodiment of the disclosure.

With reference now to the drawings, and in particular to FIGS. 1 through 9 thereof, a new retrieving device embodying the principles and concepts of an embodiment of the disclosure and generally designated by the reference numeral 10 will be described.

As best illustrated in FIGS. 1 through 9, the ball retrieving assembly 10 generally comprises a basket 12 that has a pair of elastomeric openings 14 integrated into the basket 12. Each of the elastomeric openings 14 can pass a ball 16 into the basket 12 for transporting the ball 16. The ball 16 may be a tennis ball or other type of ball for playing a competitive game. The basket 12 has a bottom wall 18 and an outer wall 20 extending upwardly therefrom, and the outer wall 20 has a first lateral side 22 and a second lateral side 24. The bottom wall 18 has a pair of cuts 26 each extending through the bottom wall 18 and each of the cuts 26 is elongated to extend substantially between the first lateral side 22 and the second lateral side 24 of the outer wall 20. Moreover, each of the cuts 26 has a bounding edge 28 and the bounding edge 28 of each of the cuts 26 is comprised of a resiliently stretchable material such that each of the pair of cuts 26 defines the elastomeric openings 14. The bounding edge 28 of each of the cuts 26 are biased together to close the cuts 26.

The bottom wall 18 is comprised of a mesh material thereby facilitating the bottom wall 18 to be flexible to conform to a plurality of balls 16 which are positioned in the basket 12. The outer wall 20 has a central portion 30 that is bounded by a lower portion 32 and an upper portion 34. The central portion 30 is comprised of a mesh material thereby facilitating the central portion 30 to be flexible. Additionally, each of the lower portion 32 and the upper portion 34 is comprised of a rigid material thereby facilitating structural support for the basket 12.

A plurality of rollers 36 is each movably coupled to the basket 12. Each of the rollers 36 comprises a first portion 38 that is compressible into a second portion 40 such that each of the rollers 36 has an adjustable length. Each of the rollers 36 includes a wheel 42 that is rotatably coupled to a distal end 44 of the first portion 38. Each of the rollers 36 is biased into an extended condition to space the basket 12 upwardly from a support surface 46. The support surface 46 may be the ground, a playing court or other horizontal support surface upon which a plurality of balls 16 might have collected.

Each of the rollers 36 is urgeable into a compressed condition to facilitate the basket 12 to be lowered to the support surface 46. In this way the balls 16 lying on the support surface 46 can pass through respective ones of the elastomeric openings 14 for positioning the balls 16 in the basket 12. The second portion 40 of each of the rollers 36 is coupled to the lower portion 32 of the outer wall 20 of the basket 12 having the first portion 38 extending downwardly on the basket 12 such that the wheel 42 on the first portion 38 can roll on the support surface 46. The first portion 38 and the second portion 40 of each of the rollers 36 may comprise a spring loaded cylinder, a gas charged shock absorber or other type of resiliently compressible device. Additionally, the wheel 42 on the first portion 38 of each of the rollers 36 may comprise a caster or other type of wheel. The first portion 38 and the second portion 40 of each of the rollers 36 is positioned inside of the basket 12, and the first portion 38 and the second portion 40 of each of the rollers 36 might include a locking mechanism to lock the rollers 36 in the compressed condition.

A plurality of tubes 48 is provided and each of the tubes 48 has an outer wall 49 and an upper end 50. The outer wall 49 of each of the tubes 48 is coupled to the upper portion 34 of the outer wall 20 of the basket 12 having the upper end 50 of each of the tubes 48 being directed upwardly beyond the outer wall 20. Additionally, each of the tubes 48 is positioned on a respective first lateral side 22 and second lateral side 24 of the outer wall 20. The outer wall 49 of each of the tubes 48 has a hole 52 extending through the outer wall 49 and the hole 52 is positioned adjacent to the upper end 50. Additionally, each of the tubes 48 is positioned inside of the basket 12.

A pair of handles 54 is each removably attachable to the basket 12 thereby facilitating each of the rollers 36 to be urged into the compressed condition when handles 54 are pressed downwardly. In this way the pair of handles 54 facilitates the balls 16 to be placed into the basket 12 in a hands-free manner. Thus, a user does not have to bend over to collect the balls 16 from the support surface 46. Each of the handles 54 has a central portion 56 extending between a pair of end portions 58. Each of the end portions 58 has a distal end 60 with respect to the central portion 30. Additionally, the upper end 50 of each of the tubes 48 insertably receives the distal end 60 of a respective one of the end portions 58 of a respective handle 54 having the central portion 30 of each of the handles 54 being horizontally oriented. A plurality of pads 62 is positioned around respective handles 54 and the pads 62 are positioned on the central portion 56 of the handles 54

A plurality of locks 64 may each be movably integrated into a respective one of the end portions 58 of a respective one of the handles 54. Each of the locks 64 is positioned adjacent to the distal end 60 of the respective end portion 58 and each of the locks 64 is biased outwardly from the respective end portion 58. Additionally, each of the locks 64 engages hole 52 in the outer wall 49 of a respective one of the tubes 48 for retaining the handles 54 in an extended position. As is most clearly shown in FIGS. 4 and 5, each of the locks 64 can be disengaged from the hole 52 to facilitate the handles 54 to be lowered into the tubes 48 for storage.

In use, the basket 12 is rolled along the support surface 46 to position the basket 12 over balls 16 that are lying on the support surface 46. The handles 54 are pushed downwardly to facilitate the bottom wall 18 of the basket 12 to be positioned on the support surface 46. Moreover, each of the balls 16 passes through the cuts 26 in the bottom wall 18 to enter the basket 12. The handles 54 are released and the bottom wall 18 is lifted from the support surface 46 while the balls 16 remain in the basket 12. The basket 12 is rolled around in order to gather all of the balls 16 that are lying on the support surface 46. In this way the balls 16 can be gathered in a hands free manner.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ball retrieving assembly for picking up balls from the ground and storing the balls for subsequent storage, said assembly comprising:

a basket having a pair of elastomeric openings being integrated into said basket wherein each of said elastomeric openings is configured to pass a ball into said basket for transporting the ball;

a plurality of rollers, each of said rollers being movably coupled to said basket, each of said rollers comprising a first portion being compressible into a second portion such that each of said rollers has an adjustable length, each of said rollers being biased into an extended condition wherein each of said rollers is configured to space said basket upwardly from a support surface, each of said rollers being urgeable into a compressed condition wherein each of said rollers is configured to facilitate said basket to be lowered to the support surface thereby facilitating balls lying on the support surface to pass through respective ones of said elastomeric openings for positioning the balls in said basket;

a pair of handles, each of said handles being removably attachable to said basket thereby facilitating each of said rollers to be urged into said compressed condition when handles are pressed downwardly wherein said pair of handles is configured to facilitate the balls to be placed into said basket in a hands-free manner; and wherein said basket has a bottom wall and an outer wall extending upwardly therefrom, said outer wall having a first lateral side and a second lateral side, said bottom wall having a pair of cuts each extending through said bottom wall, each of said cuts being elongated to extend substantially between said first lateral side and said second lateral side of said outer wall, each of said cuts having a bounding edge, said bounding edge of each of said cuts being comprised of a resiliently stretchable material such that each of said pair of cuts defines said elastomeric openings, said bounding edge of each of said cuts being biased together to close said cuts.

2. The assembly according to claim 1, wherein said bottom wall is comprised of a mesh material thereby facilitating said bottom wall to be flexible wherein said bottom wall is configured to conform to a plurality of balls being positioned in said basket, said outer wall having a central portion being bounded by a lower portion and an upper portion, said central portion being comprised of a mesh material thereby facilitating said central portion to be flexible, each of said lower portion and said upper portion being comprised of a rigid material thereby facilitating structural support for said basket.

3. The assembly according to claim 2, further comprising each of said rollers including a wheel being rotatably coupled to a distal end of said first portion, wherein said second portion of each of said rollers is coupled to said lower portion of said outer wall of said basket having said first portion extending downwardly on said basket wherein said wheel on said first portion is configured to roll on the support surface.

4. The assembly according to claim 2, further comprising a plurality of tubes, each of said tubes having an outer wall and an upper end, said outer wall of each of said tubes being coupled to said upper portion of said outer wall of said basket having said upper end of each of said tubes being directed upwardly beyond said outer wall, each of said tubes being positioned on a respective first lateral side and second lateral side of said outer wall.

5. The assembly according to claim 2, wherein each of said handles has a central portion extending between a pair of end portions, each of said end portions having a distal end with respect to said central portion, said upper end of each of said tubes insertably receiving said distal end of a respective one of said end portions of a respective handle having said central portion of each of said handles being horizontally oriented.

6. A ball retrieving assembly for picking up balls from the ground and storing the balls for subsequent storage, said assembly comprising:

a basket having a pair of elastomeric openings being integrated into said basket wherein each of said elastomeric openings is configured to pass a ball into said basket for transporting the ball, said basket having a bottom wall and an outer wall extending upwardly therefrom, said outer wall having a first lateral side and a second lateral side, said bottom wall having a pair of cuts each extending through said bottom wall, each of said cuts being elongated to extend substantially between said first lateral side and said second lateral side of said outer wall, each of said cuts having a bounding edge, said bounding edge of each of said cuts being comprised of a resiliently stretchable material such that each of said pair of cuts defines said elastomeric openings, said bounding edge of each of said cuts being biased together to close said cuts, said bottom wall being comprised of a mesh material thereby facilitating said bottom wall to be flexible wherein said bottom wall is configured to conform to a plurality of balls being positioned in said basket, said outer wall having a central portion being bounded by a lower portion and an upper portion, said central portion being comprised of a mesh material thereby facilitating said central portion to be flexible, each of said lower portion and said upper portion being comprised of a rigid material thereby facilitating structural support for said basket;

a plurality of rollers, each of said rollers being movably coupled to said basket, each of said rollers comprising a first portion being compressible into a second portion such that each of said rollers has an adjustable length, each of said rollers including a wheel being rotatably coupled to a distal end of said first portion, each of said rollers being biased into an extended condition wherein each of said rollers is configured to space said basket upwardly from a support surface, each of said rollers being urgeable into a compressed condition wherein each of said rollers is configured to facilitate said basket to be lowered to the support surface thereby facilitating balls lying on the support surface to pass through respective ones of said elastomeric openings for positioning the balls in said basket, said second portion of each of said rollers being coupled to said lower portion of said outer wall of said basket having said first portion extending downwardly on said basket wherein said wheel on said first portion is configured to roll on the support surface;

a plurality of tubes, each of said tubes having an outer wall and an upper end, said outer wall of each of said tubes being coupled to said upper portion of said outer wall of said basket having said upper end of each of said tubes being directed upwardly beyond said outer wall, each of said tubes being positioned on a respective first lateral side and second lateral side of said outer wall;

a pair of handles, each of said handles being removably attachable to said basket thereby facilitating each of said rollers to be urged into said compressed condition when handles are pressed downwardly wherein said pair of handles is configured to facilitate the balls to be placed into said basket in a hands-free manner, each of said handles having a central portion extending between a pair of end portions, each of said end portions having a distal end with respect to said central portion, said upper end of each of said tubes insertably receiving said distal end of a respective one of said end portions of a respective handle having said central portion of each of said handles being horizontally oriented.

* * * * *